US009719156B2

(12) United States Patent
Howells et al.

(10) Patent No.: US 9,719,156 B2
(45) Date of Patent: Aug. 1, 2017

(54) ALUMINUM FIN ALLOY AND METHOD OF MAKING THE SAME

(71) Applicant: Novelis Inc., Atlanta, GA (US)

(72) Inventors: Andrew D. Howells, Kingston (CA); Kevin Michael Gatenby, Kingston (CA); Pierre Henri Marois, Kingston (CA); Thomas L. Davisson, Mishawaka, IN (US); Fred Perdriset, Cheres (FR)

(73) Assignee: Novelis Inc., Atlanta, GA (US)

( * ) Notice: Subject to any disclaimer, the term of this patent is extended or adjusted under 35 U.S.C. 154(b) by 172 days.

(21) Appl. No.: 13/708,644

(22) Filed: Dec. 7, 2012

(65) Prior Publication Data

US 2013/0156634 A1 Jun. 20, 2013

Related U.S. Application Data

(60) Provisional application No. 61/576,602, filed on Dec. 16, 2011.

(51) Int. Cl.

| | |
|---|---|
| ***C22C 21/00*** | (2006.01) |
| ***B22D 11/12*** | (2006.01) |
| ***B22D 11/00*** | (2006.01) |
| ***B22D 11/06*** | (2006.01) |
| ***C22C 21/10*** | (2006.01) |
| *F28F 21/08* | (2006.01) |

(52) U.S. Cl.

CPC ..... *C22C 21/00* (2013.01); *B22D 11/003* (2013.01); *B22D 11/0622* (2013.01); *B22D 11/12* (2013.01); *B22D 11/1206* (2013.01); *C22C 21/10* (2013.01); *F28F 21/084* (2013.01)

(58) Field of Classification Search

CPC ..... C22C 21/00; C22C 21/02; C22C 21/10; C22C 21/12; C22C 21/14; C22C 21/18

USPC ..... 420/531, 537

See application file for complete search history.

(56) References Cited

U.S. PATENT DOCUMENTS

| | | | |
|---|---|---|---|
| 4,571,368 | A | 2/1986 | Fenoglio et al. |
| 5,079,087 | A | 1/1992 | Lever et al. |
| 5,217,547 | A | 6/1993 | Ishikawa et al. |
| 5,616,189 | A | 4/1997 | Jin et al. |
| 5,857,266 | A | 1/1999 | Raybould et al. |
| 6,153,025 | A | 11/2000 | Auran et al. |
| 6,165,291 | A | 12/2000 | Jin et al. |
| 6,238,497 | B1 | 5/2001 | Jin et al. |
| 6,408,938 | B2 | 6/2002 | Gray et al. |
| 6,592,688 | B2 | 7/2003 | Jin et al. |
| 6,610,247 | B2 | 8/2003 | Wittebrood et al. |
| 6,620,265 | B2 | 9/2003 | Kawahara et al. |
| 6,644,388 | B1 | 11/2003 | Kilmer et al. |
| 6,800,244 | B2 | 10/2004 | Wittebrood et al. |
| 6,925,711 | B2 | 8/2005 | Kilmer et al. |
| 6,959,853 | B2 | 11/2005 | Graham et al. |
| 7,000,823 | B2 | 2/2006 | Dockus et al. |
| 7,018,722 | B2 | 3/2006 | Toyama et al. |
| 7,172,664 | B2 | 2/2007 | Davisson et al. |
| 2001/0001402 | A1 | 5/2001 | Jin et al. |
| 2001/0028960 | A1 | 10/2001 | Gray et al. |
| 2002/0001727 | A1 | 1/2002 | Robbins |
| 2002/0007881 | A1 | 1/2002 | Daaland et al. |
| 2002/0173614 | A1 | 11/2002 | Robbins |
| 2003/0086812 | A1 | 5/2003 | Wittebrood et al. |
| 2003/0102060 | A1 | 6/2003 | Daaland et al. |
| 2004/0028940 | A1 | 2/2004 | Toyama et al. |
| 2004/0068871 | A1 | 4/2004 | Kilmer et al. |
| 2004/0086417 | A1 | 5/2004 | Baumann et al. |
| 2004/0118492 | A1 | 6/2004 | Stenqvist |
| 2004/0182482 | A1 | 9/2004 | Gray et al. |
| 2005/0019204 | A1 | 1/2005 | Haller et al. |
| 2005/0019205 | A1 | 1/2005 | Davisson et al. |
| 2005/0106410 | A1 | 5/2005 | Jiang et al. |
| 2005/0150642 | A1 | 7/2005 | Baumann |
| 2005/0211345 | A1 | 9/2005 | Baumann et al. |
| 2007/0286763 | A1 | 12/2007 | Sicking et al. |

(Continued)

FOREIGN PATENT DOCUMENTS

| | | | |
|---|---|---|---|
| CA | 2391381 | A1 | 5/2001 |
| CA | 2553910 | A1 | 8/2005 |

(Continued)

OTHER PUBLICATIONS

Korean Patent Application No. 10-2014-7019587, Office Action mailed Oct. 29, 2015, 8 pages.

(Continued)

*Primary Examiner* — Jessee Roe
*Assistant Examiner* — Jenny Wu
(74) *Attorney, Agent, or Firm* — Kilpatrick Townsend & Stockton LLP

(57) ABSTRACT

The present invention relates to an aluminum alloy product for use as a finstock material within brazed heat exchangers and, more particularly, to a finstock material having high strength and conductivity after brazing. The invention is an aluminum alloy finstock comprising the following composition in weight %:

| | |
|---|---|
| Fe | 0.8-1.25; |
| Si | 0.8-1.25; |
| Mn | 0.70-1.50; |
| Cu | 0.05-0.50; |
| Zn | up to 2.5; |

other elements less than or equal to 0.05 each and less than or equal to 0.15 in total; and balance aluminum.

The invention also relates to a method of making the finstock material.

18 Claims, 1 Drawing Sheet

(56) References Cited

U.S. PATENT DOCUMENTS

| | | | | |
|---|---|---|---|---|
| 2008/0118393 | A1 | 5/2008 | Oskarsson et al. | |
| 2009/0308500 | A1* | 12/2009 | Suzuki et al. | 148/523 |
| 2010/0012229 | A1 | 1/2010 | Oskarsson et al. | |
| 2011/0076184 | A1 | 3/2011 | Zhang et al. | |
| 2012/0129003 | A1 | 5/2012 | Ando et al. | |
| 2014/0360712 | A1 | 12/2014 | Fujita et al. | |
| 2015/0041027 | A1 | 2/2015 | Howells et al. | |
| 2016/0040947 | A1 | 2/2016 | Gatenby et al. | |
| 2016/0195346 | A1 | 7/2016 | Howells et al. | |

FOREIGN PATENT DOCUMENTS

| | | | | | |
|---|---|---|---|---|---|
| CA | 2607784 | A1 | | 4/2008 | |
| CN | 105452499 | A | | 3/2016 | |
| CN | 105593391 | A | | 5/2016 | |
| EP | 0091231 | A1 | | 10/1983 | |
| EP | 1242643 | B1 | | 9/2002 | |
| EP | 1300480 | A1 | | 4/2003 | |
| EP | 1435397 | A1 | | 7/2004 | |
| EP | 1 693 475 | A2 | | 8/2006 | |
| EP | 1693475 | A3 | | 9/2006 | |
| EP | 1717327 | A1 | | 11/2006 | |
| EP | 1753885 | A1 | | 2/2007 | |
| EP | 1 918 394 | A2 | | 5/2008 | |
| EP | 2 048 252 | A1 | | 4/2009 | |
| EP | 2551364 | A1 | | 1/2013 | |
| EP | 3030684 | A1 | | 6/2016 | |
| EP | 3030685 | A1 | | 6/2016 | |
| GB | 2390099 | A | * | 12/2003 | B32B 15/016 |
| JP | S62196348 | A | | 8/1987 | |
| JP | 08143998 | A | * | 6/1996 | |
| JP | H1081932 | A | | 3/1998 | |
| JP | H1088265 | A | | 4/1998 | |
| JP | 2002161323 | | | 6/2002 | |
| JP | 2002161324 | | | 6/2002 | |
| JP | 2002161324 | A | * | 6/2002 | |
| JP | 2002241910 | A | | 8/2002 | |
| JP | 2002256364 | | | 9/2002 | |
| JP | 3333600 | | | 10/2002 | |
| JP | 3505825 | | | 3/2004 | |
| JP | 2006225719 | A | | 8/2006 | |
| JP | 2006225723 | A | | 8/2006 | |
| JP | 2008308760 | A | | 12/2008 | |
| JP | 2010185646 | A | * | 8/2010 | |
| JP | 2010255120 | A | | 11/2010 | |
| JP | 2011042853 | A | * | 3/2011 | |
| JP | 2012026008 | A | | 2/2012 | |
| JP | 2012126950 | A | | 7/2012 | |
| JP | 2013040367 | A | | 2/2013 | |
| JP | 2016531204 | A | | 10/2016 | |
| JP | 2016534223 | A | | 11/2016 | |
| WO | WO 00/05426 | A1 | | 2/2000 | |
| WO | WO 01/53552 | A1 | | 7/2001 | |
| WO | WO 01/53553 | A1 | | 7/2001 | |
| WO | WO 2004/094679 | A1 | | 11/2004 | |
| WO | WO 2007/013380 | A1 | | 2/2007 | |
| WO | 2012143183 | A1 | | 10/2012 | |
| WO | 2013111884 | A1 | | 8/2013 | |
| WO | 2015021244 | A1 | | 2/2015 | |
| WO | 2015021383 | A1 | | 2/2015 | |
| WO | 2016022457 | A1 | | 2/2016 | |

OTHER PUBLICATIONS

European Patent Application No. 12 857 679.0, Extended European Search Report mailed Jan. 29, 2016, 5 pages.

Japanese Patent Application No. 2014-546251, Office Action mailed Mar. 1, 2016, 5 pages.

Japanese Patent Application No. 2014-546251, Office Action (Decision of Rejection) mailed Jun. 21, 2016, 6 pages.

Korean Patent Application No. 10-2014-7019587, Final Rejection mailed Apr. 28, 2016, 5 pages.

Japanese Patent Application No. 2016-012357, Report of Preexamination on Appeal mailed Sep. 29, 2016, 4 pages.

International Patent Application No. PCT/CA2012/050858, International Search Report & Written Opinion, mailed May 22, 2013, 8 pages.

Aleris Rolled & Extruded Product, "Aluminium heat exchanger materials, Availability of heat exchanger materials—Clad alloys", Internet Citation, URL:http://www.aleris.com/sitesjdefault/files/Aluminium%20heat%20exchanger%20materials_issue%202007_5.pdf, May 9, 2007, 20 pages.

Japan Aluminum Association Corporation, "Metal Material Series Utilizing On-site Aluminum," Nov. 9, 2007, pp. 185-194, Kogyo Chosakai Publishing Co., Ltd., Japan.

Canadian Patent Application No. 2,856,488, Office Action mailed Feb. 10, 2017, 4 pages.

Korean Patent Application No. 10-2014-7019587, Second Final Rejection mailed Jun. 20, 2016, 7 pages.

* cited by examiner

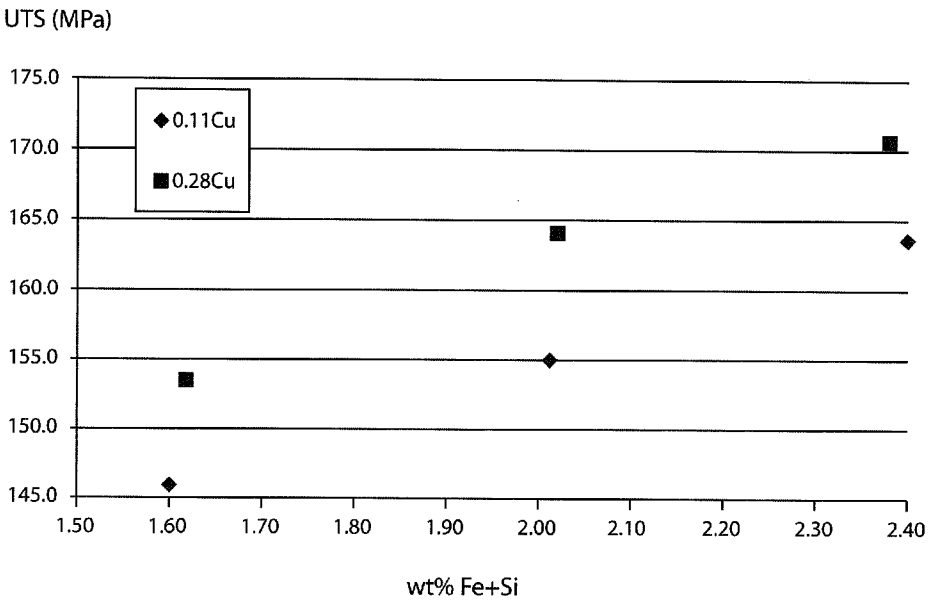
UTS (MPa)
175.0
170.0
165.0
160.0
155.0
150.0
145.0
0.11Cu
0.28Cu
1.50
1.60
1.70
1.80
1.90
2.00
2.10
2.20
2.30
2.40
wt% Fe+Si

ALUMINUM FIN ALLOY AND METHOD OF MAKING THE SAME

CROSS-REFERENCE TO RELATED APPLICATIONS

This application claims the priority right of prior co-pending provisional patent application Ser. No. 61/576,602 filed Dec. 16, 2011 by applicants named herein. The entire contents of application Ser. No. 61/576,602 are specifically incorporated herein by this reference.

BACKGROUND OF THE INVENTION

1. Field of the Invention

The present invention relates to aluminum alloy products for use as finstock materials within brazed heat exchangers and more particularly to finstock materials having high strength and conductivity after brazing and good sag resistance. The invention also relates to a method of making such finstock materials.

2. Background Art

Aluminum alloys have been used in the production of automotive radiators for many years, such radiators typically comprising fins and tubes, the tubes containing cooling fluid. The fins and tubes are usually joined in a brazing operation. The finstock material is normally fabricated from a so-called 3XXX series aluminum alloy where the main alloying element added to the aluminum melt is manganese (see "International Alloy Designations and Chemical Composition Limits for Wrought Aluminum and Wrought Aluminum Alloys", published by The Aluminum Association, revised in January 2001; the disclosure of which is specifically incorporated herein by this reference).

There is a continuous need for improved finstock materials to satisfy the demand for reductions in vehicle and component weight. In order to achieve weight reductions various properties need to be optimized. Principally, that means maintaining or improving the strength of the finstock material after brazing, without detriment to the thermal conductivity and the sag resistance. Sag resistance is resistance to high temperature creep during the brazing cycle which is the main reason for collapse of fins during the brazing of heat exchanger units. Thermal conductivity, of course, has a direct impact on the thermal performance of the heat exchanger unit, the other properties being essential for the structural stability of the unit. Besides these properties, the finstock must provide sacrificial protection to the tubes whilst avoiding deterioration through corrosion. It is common practice to make the fins electronegative relative to the tubes so that the fins act as sacrificial anodes. There is a need to balance this sacrificial effect with the need to maintain thermal performance during the service life of the heat exchanger. If the fins corrode too quickly thermal performance is compromised.

European Patent Publication EP1918394 describes a method of making an Al—Mn foil for use as fins in heat exchangers in which an alloy is used within the following composition range (all composition values hereinafter are expressed in weight %): 0.3-1.5 Si, ≤0.5 Fe, ≤0.3 Cu, 1.0-2.0 Mn, ≤0.5 Mg, ≤4.0 Zn, ≤0.3 of each of elements from group IVb, Vb or VIb elements, the sum of these elements being ≤0.5, unavoidable impurities and the remainder aluminum. The alloy may be twin roll cast, rolled, interannealed, cold rolled again, and then heat treated to avoid recrystallization of the foil. Although pre- and post-brazing strengths are reported, the electrical conductivity is not stated.

European Patent Publication EP1693475 describes an aluminum fin alloy with 1.4-1.8 Fe, 0.8-1.0 Si and 0.6-0.9 Mn where the surface grain structure is controlled such that more than 80% of the grains are recrystallized. This alloy was continuously cast by twin roll casting. Although sag resistance and electrical conductivity were good, the strength after brazing was below 140 MPa. The microstructure is characterised by the presence of Al—Fe—Mn—Si intermetallics.

European Patent Publication EP2048252 describes an aluminum fin alloy with the following composition: Si 0.7-1.4, Fe 0.5-1.4, Mn 0.7-1.4, Zn 0.5-2.5, other elements ≤0.05, balance aluminum where the sheet product has an Ultimate Tensile Strength (UTS) after brazing ≤130 Mpa and a Yield Strength (YS) ≥45 Mpa, a recrystallized grain size ≥500 μm and an electrical conductivity ≥47IACS. This product is manufactured from a belt cast strip, the thickness of the cast strip being between 5 and 10 mm.

US Patent Publication US-A-2005/0106410 describes a clad finstock material wherein the core material consists of an alloy containing 0.10-1.50 Si, 0.10-0.60 Fe, up to 1.00 Cu, 0.70-1.80 Mn, up to 0.40 Mg, 0.10-3.00 Zn, up to 0.30 Ti, up to 0.30 Zr, balance Al and impurities, and the clad layer is an Al—Si based alloy. No thermal conductivity data are reported. The post-braze strength reported was 136 or 146 MPa but the actual alloys which provided these values are not stated.

U.S. Pat. No. 6,620,265 describes twin roll casting an aluminum alloy with the following main alloying elements: 0.6-1.8 Mn, 1.2-2.0 Fe and 0.6-1.2 Si, where the casting load is controlled, and including at least two interannealing steps during cold rolling and in such a way as to avoid complete recrystallization. Sag resistance and conductivity were good but post-brazing strength was below 140 MPa.

US Patent Publication US-A-2005/0150642 describes an aluminum finstock material comprising the following composition: about 0.7-1.2 Si, 1.9-2.4 Fe, 0.6-1.0 Mn, up to about 0.5 Mg, up to about 2.5 Zn, up to about 0.10 Ti, up to about 0.03 In, remainder aluminum and impurities. This finstock material, which can be continuously cast, provides a conductivity >48% IACS and a post-brazing strength of >120 MPa. After a commercial brazing cycle involving a cooling rate of around 70° C./minute from the peak temperature to below 500° C., the post-braze strength was 130 or 131 MPa.

U.S. Pat. No. 7,018,722 describes a clad finstock material comprising a core and two clad layers, the core composition being selected from a wide range and the clad layers being selected from an Al—Si alloy. The invention concerns controlling the Si content in the core layer so that there is a difference between the Si concentration at the surface (0.8 or more) and in the middle of the core (0.7 or less). No mechanical property data or electrical conductivity data are reported.

PCT patent publication WO07/013,380 describes an aluminum alloy for use as finstock comprising the following composition: 0.8-1.4 Si, 0.15-0.7 Fe, 1.5-3.0 Mn, 0.5-2.5 Zn, remainder impurities and aluminum. This alloy is produced by twin belt casting. Although the strength levels after brazing are good, the conductivity is relatively low with a maximum reported value of 45.8% IACS.

U.S. Pat. No. 6,592,688 describes a continuously cast alloy containing 1.2-1.8 Fe, 0.7-0.95 Si, 0.3-0.5 Mn, 0.3-1.2 Zn, balance Al. The conductivity after brazing was >49.8% IACS and the post-brazing strength was >127 MPa. None of the examples showed a post-brazing strength above 140 MPa.

U.S. Pat. No. 6,165,291 describes a process for making finstock material where the process is applicable to alloys within the following compositional range: 1.2-2.4 Fe, 0.5-1.1 Si, 0.3-0.6 Mn, up to 1.0 Zn, other elements <0.05 and balance Al. The process involves twin roll casting to provide very high cooling rates during casting together with control of the cold rolling and interanneal conditions. The resulting finstock material is reported to have a conductivity greater than 49% IACS with a post-braze strength >127 MPa.

U.S. Pat. No. 6,238,497 describes a method of producing aluminum finstock material comprising continuously casting a strip, optionally hot rolling and then cold rolling, interannealing and further cold rolling. The method is applied to an alloy having the composition: 1.6-2.4 Fe, 0.7-1.1 Si, 0.3-0.6 Mn, 0.3-2.0 Zn, other elements <0.05 and balance Al. The resulting finstock material is reported to have a conductivity greater than 49% IACS with a post-braze strength >127 MPa.

The balance of properties varies from one reference to another. Occasionally a high thermal conductivity can be achieved but this is at the expense of strength after brazing. In other cases the situation is reversed.

It would be desirable to provide a finstock material having high strength and conductivity after brazing, with sufficient corrosion performance to ensure there is sacrificial protection to the tubes of the heat exchanger whilst avoiding rapid deterioration of the fins.

SUMMARY OF THE INVENTION

An embodiment of this invention provides an aluminum finstock comprising the following composition (all values in weight %):

| | |
|---|---|
| Fe | 0.8-1.25; |
| Si | 0.8-1.25; |
| Mn | 0.7-1.5; |
| Cu | 0.05-0.5; |
| Zn | optional, up to 2.5; |

other elements, if present at all, <0.05 each and <0.15 in total; and aluminum making up the balance.

The term "other elements" includes impurities and trace elements and is also intended to include small amounts of grain refining additions (for example Ti and B) that may be present as a result of deliberate practice typical within the industry.

The compositional elements are selected for the following reasons. The alloy is designed to give a high post-brazed strength without the addition of excessive amounts of solid solution strengthening elements. With appropriate process and composition control of the main alloying additions Fe, Si, Mn and Cu, the resultant microstructure at final gauge exhibits a high number density of fine, as-cast, intermetallic particles. The size of these particles is such that, although they are relatively fine when compared with the size one would see if the alloy were direct-chill (DC) cast, they remain large enough such that they do not entirely dissolve and go into solid solution during the brazing cycle. This provides additional post-braze strength through particle strengthening without compromising the electrical conductivity.

Close control of the Fe and Si contents is required to produce monoclinic beta particles during casting. These ternary Al—Fe—Si particles do not allow the substitution of Mn for Fe due to their stoichiometry and crystal lattice structure. As a result, during casting, the Mn largely remains in solid solution while a small amount is precipitated during hot rolling and interannealing as fine dispersoids. The effect of this microstructure is that, when the material is heated to 600° C. as in a brazing operation, the material retains strength due to the solid solution strengthening effects of the Mn.

As a result, the strengthening effect is higher than would be expected at this relatively low level of Mn in situations where Mn is incorporated into other Al—Fe—Si intermetallics. In other words, if the Fe and Si contents are at a level such that the as-cast particles are predominantly cubic-alpha Al—Fe—Si, which allows Mn to substitute for Fe atoms, then the resultant strength after brazing would be lower, even if the Mn levels in the alloy were the same. Cubic alpha particles, due to their relatively large size, are unable to be re-dissolved and taken into solution during the relatively short brazing cycle.

In this way the addition of Mn is optimized to provide a useful balance of properties. Sufficient Mn, (optionally in combination with Cu), is added to provide strength, but not so much to adversely affect the electrical and thermal conductivity.

Both the Fe and Si contents are selected to be from 0.8-1.25 wt %. Below 0.8 wt %, inadequate strength is achieved because the number and size of intermetallic particles is too low. Above 1.25 wt % the conductivity of the finstock is too low. Ideally there is a close match between the Fe and Si contents to ensure formation of the beta phase and it is preferred that they are approximately equal in content. The term approximately equal is used because, as the skilled person well knows, it is impossible when casting metal to control the cast composition precisely each and every time. Preferably the content of both Fe and Si is between 0.9-1.1 wt % and even more preferably they are both around 1.0 wt %.

The Mn content is selected to be between 0.7-1.5 wt %. A content below 0.7 wt % leads to insufficient strength. A content above 1.5 wt % leads to falls in conductivity. There is not a significant change in strength from a Mn content of 0.7 wt % to 1.5 wt % whilst the conductivity is higher at the lower Mn content. Therefore, a preferred range for Mn is 0.7-1.0 wt %.

A small addition of Cu increases the post-brazing strength and may contribute to the formation of the large pancake grains which improve the sag resistance properties. Cu above 0.5 wt % may lead to corrosion problems. For these reasons the Cu content is set between 0.05 and 0.5 wt %.

Zn is known to affect the anodic potential of an aluminum-based alloy. Zn additions will cause an aluminum alloy to become more electronegative (sacrificial). It is preferable in heat exchanger units that the fin material is sacrificial to the tube material and that will depend on the composition of the tube material itself. In practice this will mean that some manufacturers require a fin alloy with no Zn addition, as long as the potential of the fin is more electronegative than the tube. On the other hand, if the free corrosion potential of the tube material is already electronegative, then Zn may need to be added to the fin to further its electronegativity and render it sacrificial. If the Zn content is too high, e.g. >2.5 wt %, the self corrosion of the fin material deteriorates and the thermal efficiency of the heat exchanger unit rapidly decreases. For these reasons Zn is an optional element but may be present in amounts up to 2.5 wt %. The electrical conductivity of the alloy is further improved by the addition of Zn and, in situations where a higher conductivity alloy is desired, (>48% IACS), Zn may be added in an amount 0.25-2.5 wt %.

The composition and process control ensure that the material, even when rolled to gauges below 0.07 mm, has a high sag resistance. When an assembled heat exchanger undergoes controlled atmosphere brazing, the finstock, tubestock and headerstock materials are subject to temperatures in the range of 595-610° C. At these temperatures the aluminum components will start to creep. Although the duration for brazing is short, the thin gauge of the materials used and the very high temperatures make creep a particular problem for automotive finstock. This high temperature creep is also referred to as "sag" and the ability of a material to withstand this form of creep is called sag resistance. As the gauge of finstock is reduced the ability of the finstock to withstand sagging during the brazing operation becomes more important. Finstock materials with equiaxed grain structures are highly prone to creep whilst those with a pancake grain structure show greater sag resistance. The Mn content of this invention delays recrystallization of the grain structure, thus reducing the tendency to form equiaxed grains. The fine distribution of intermetallics present after continuous casting and rolling to final gauge prevents grains growing through the sheet thickness although they do allow the growth of grains in the rolling plane. The delay of recrystallization and the promotion of grain growth in the rolling direction enable the alloy of this invention to develop a pancake grain structure and satisfactory sag resistance.

It is another feature of this invention that the balance of properties is obtained in a finstock material as thin as 0.05 mm. Normally finstock materials are supplied in gauges of around 0.07 mm. Although the difference is small, in percentage terms a loss of 0.02 mm is significant and will provide meaningful weight savings. The alloy and process of the invention will provide desirable results at higher gauges but the gauge of the finstock according to this invention may be below 0.07 mm, alternatively <0.06 mm and alternatively <0.055 mm.

As a result of controlling the composition and microstructure in this way a product has been developed which exhibits the following balance of properties. The ultimate tensile strength (UTS) is ≥140 Mpa and the electrical conductivity is ≥46% IACS after brazing at 600° C.

According to another exemplary embodiment of the invention, a method of manufacturing the finstock is provided. The method comprises the steps of continuously casting the inventive alloy to form a strip of 4-10 mm thick, optionally hot rolling the as-cast strip to 1-5 mm thick sheet, cold rolling the as-cast strip or hot rolled sheet to 0.07-0.20 mm thick sheet, annealing the intermediate sheet at 340-450° C. for 1-6 hours, and cold rolling the intermediate sheet to final gauge (0.05-0.10 mm).

If hot rolling is carried out it is preferred that the as-cast strip enter the hot rolling process at a temperature of between about 400-550° C. The amount of cold rolling in the final rolling step may be adjusted to give an average grain size after brazing >110 μm, preferably >240 μm. For a finstock of 0.05 mm thickness, there are usually 3 grains of such a size through the thickness of the foil. The benefit of such "pancake" grains is apparent in creep (or sag) resistance.

In the casting procedure, if the average cooling rate is too slow, the intermetallic particles formed during casting will be too large, which will cause rolling problems. The intermetallics will also be of the cubic alpha variety which, as described above, is unable to be re-dissolved during the brazing cycle. A low cooling rate will generally involve DC casting and subsequent homogenization. In order to obtain a higher cooling rate during casting a continuous strip casting process should be used. A variety of alternative processes exists including twin roll casting, belt casting and block casting. For twin roll casting, the average cooling rate should not exceed about 1500° C./sec. Belt and block casting both operate at lower maximum average cooling rates of less than 250° C./sec, or more commonly below 200° C./sec. The continuous casting process creates a greater number of fine intermetallic particles and the faster the cooling rate the finer the intermetallics. In order to control the size of the intermetallics more effectively a preferred alternative is to use twin roll casting where the cooling rate is preferably greater than 200° C./sec.

BRIEF DESCRIPTION OF THE DRAWING

The following Examples are provided as further illustration of the exemplary embodiments. In the following, reference is made to the accompanying drawing, in which the FIGURE is a graph showing the effect of Fe, Si and Cu on the ultimate tensile strength (UTS) of the alloys of Example 3 after brazing.

EXAMPLE 1

Alloys with compositions shown in Table 1, (all values in weight %), were twin roll cast to a gauge of 6.0 mm and then cold rolled in a number of rolling steps to a gauge of 0.78 mm. The intermediate sheet of 0.78 mm gauge was annealed is with a peak furnace temperature of 420° C. for a total cycle time of 35 hrs. After this interanneal, the sheet gauge was further reduced to finstock by cold rolling in steps down to a final gauge of 0.052 mm to provide material in an H18 temper. Four alloys were prepared.

TABLE 1

| Sample # | Fe | Si | Mn | Cu |
|---|---|---|---|---|
| A | 0.99 | 0.96 | 0.73 | 0.17 |
| B | 1.01 | 0.97 | 1.30 | 0.15 |
| C | 0.71 | 0.65 | 0.71 | 0.16 |
| D | 0.70 | 0.65 | 1.33 | 0.17 |

In each case other elements present as impurities and trace elements were <0.05 and the balance was Al.

Samples A and B are alloys according to the invention, samples C and D are alloys outside the scope of the invention.

The final gauge finstock was then subject to a brazing cycle intended to simulate typical industrial controlled-atmosphere brazing conditions. The brazing cycle involved placing samples in a controlled atmosphere furnace preheated to 570° C., the temperature was then raised to 600° C. in approximately 12 minutes and held at 600° C. for 3 minutes, after which the furnace was allowed to cool to 400° C. at 50° C./min, after which point the samples were removed and allowed to cool to room temperature.

Tensile properties were measured in the normal manner for material of this gauge and the conductivity after brazing was measured in accordance with JIS-N0505. The results are shown in Table 2.

TABLE 2

| Sample | UTS after brazing MPa | Electrical Conductivity % IACS |
|---|---|---|
| A | 143.1 | 48.5 |
| B | 149 | 46.0 |
| C | 126 | 47.7 |
| D | 134 | 43.2 |

The alloys according to the invention, A and B, combined high post-braze strength (above 140 MPa), and high electrical conductivity (above 46% IACS).

EXAMPLE 2

2 further alloy compositions were tested that incorporated additions of Zn. The alloy compositions are shown in Table 3, (all values in weight %).

TABLE 3

| Sample # | Fe | Si | Mn | Cu | Zn |
|---|---|---|---|---|---|
| E | 0.90 | 0.89 | 0.78 | 0.20 | 0.34 |
| F | 0.96 | 0.93 | 0.95 | 0.18 | 0.47 |

In each case other elements present as impurities and trace elements were <0.05 and the balance was Al.

Alloys according to each sample were twin roll cast to a gauge of 6.0 mm. Sample E was interannealed after hot rolling at an intermediate gauge of 0.78 mm with a peak furnace temperature of 420° C. for a total cycle time of 35 hrs and then cold rolled to a final gauge of 0.052 mm to provide material in an H18 temper.

Sample F was also provided in an H18 temper but with the interanneal occurring after hot rolling at a gauge of 0.38 mm, with the same interanneal temperature and duration as sample E.

The final gauge finstock was then subjected to the same brazing cycle as described in Example 1.

Tensile properties were measured in the normal manner for material of this gauge and the conductivity after brazing was measured in accordance with JIS-N0505. The results are shown in Table 4.

TABLE 4

| Sample | UTS after brazing MPa | Electrical Conductivity % IACS |
|---|---|---|
| E | 143 | 49.4 |
| F | 148 | 49.0 |

The addition of Zn improved the electrical conductivity but did not cause any deterioration in strength.

EXAMPLE 3

The alloys described in Table 5 were cast in "book-mould" sizes, 25 mm×150 mm×200 mm. The cast ingots were pre-heated from room temperature to 525° C. over 9 hrs and allowed to soak for 5.5 hrs. They were then hot rolled to a gauge of 5.8 mm followed by cold rolling to 0.1 mm gauge.

TABLE 5

| Sample # | Fe | Si | Mn | Cu | Fe + Si |
|---|---|---|---|---|---|
| G | 1.01 | 1.00 | 1.01 | 0.11 | 2.01 |
| H | 1.01 | 1.01 | 1.00 | 0.28 | 2.02 |
| J | 0.81 | 0.79 | 1.00 | 0.11 | 1.60 |
| K | 0.82 | 0.80 | 1.01 | 0.29 | 1.62 |
| L | 1.21 | 1.19 | 1.01 | 0.11 | 2.40 |
| M | 1.20 | 1.18 | 1.00 | 0.29 | 2.38 |

In each case other elements present as impurities and trace elements were <0.05 and the balance was Al.

They were then subjected to the same controlled-atmosphere brazing cycle as described in examples 1 and 2 and tensile tested for post-braze UTS. The properties are shown in Table 6.

TABLE 6

| Sample # | UTS (MPa) |
|---|---|
| G | 155.0 |
| H | 164.0 |
| J | 145.8 |
| K | 153.5 |
| L | 163.5 |
| M | 170.6 |

The FIGURE illustrates that, as the Fe+Si content increases, so too does the UTS after brazing and that increasing the Cu content for the same Fe+Si content also increases the UTS after brazing.

What is claimed is:

1. An aluminum alloy finstock consisting of the following composition in weight %:

| | |
|---|---|
| Fe | 0.8-1.25; |
| Si | 0.8-1.25; |
| Mn | 0.70-1.50; |
| Cu | 0.05-0.50; |
| Zn | up to 2.5; |

and balance aluminum, wherein the aluminum alloy finstock possesses a longitudinal UTS≥140 MPa and a conductivity≥46% IACS after brazing at 600° C., wherein a gauge of the aluminum alloy finstock is <0.07 mm.

2. The aluminum alloy finstock of claim 1, wherein the Si content is 0.9-1.1 weight %.

3. The aluminum alloy finstock of claim 1, wherein the Mn content is 0.9-1.1 weight %.

4. The aluminum alloy finstock of claim 1, wherein the Zn content is 0.25-2.5 weight %.

5. The aluminum alloy finstock of claim 4, wherein the aluminum alloy finstock possesses a conductivity>48% IACS after brazing.

6. The aluminum alloy finstock of claim 1, wherein the Fe content is 0.9-1.1 weight %.

7. The aluminum alloy finstock of claim 1, wherein the Mn content is 0.7-1 weight %.

8. The aluminum alloy finstock of claim 1, wherein the gauge of the aluminum alloy finstock is <0.06 mm.

9. The aluminum alloy finstock of claim 1, wherein the gauge of the aluminum alloy finstock is <0.055 mm.

10. The aluminum alloy finstock of claim 1, wherein an average grain size of the aluminum alloy finstock after brazing is >110 μm.

11. The aluminum alloy finstock of claim 1, wherein an average grain size of the aluminum alloy finstock after brazing is >240 μm.

12. A method of making aluminum alloy finstock comprising the following steps:

a) continuously casting an aluminum alloy melt consisting of the following composition in weight %:

| | |
|---|---|
| Fe | 0.9-1.25; |
| Si | 0.8-1.25; |
| Mn | 0.7-1.5; |
| Cu | 0.05-0.5; |
| Zn | up to 2.5; |

and balance aluminum;

b) hot rolling the continuously cast sheet;

c) interannealing the hot rolled sheet; and d) cold rolling the sheet to a foil gauge, wherein the aluminum alloy finstock possesses a longitudinal UTS≥140 MPa and a conductivity≥46% IACS after brazing at 600° C., wherein the foil gauge is <0.07 mm.

13. The method of claim 12, wherein the continuous casting step a) is a twin roll casting process.

14. The method of claim 12, wherein the foil gauge is <0.06 mm.

15. The method of claim 12, wherein the foil gauge is <0.055 mm.

16. An aluminum alloy finstock consisting of the following composition in weight %:

| | |
|---|---|
| Fe | 0.9-1.25; |
| Si | 0.8-1.25; |
| Mn | 0.7-1.5; |

-continued

| | |
|---|---|
| Cu | 0.05-0.5; |
| Zn | up to 2.5; |

and balance aluminum, wherein the aluminum alloy finstock is produced by a method comprising casting an aluminum alloy melt comprising the composition of the aluminum alloy finstock by a continuous strip casting process, wherein a gauge of the aluminum alloy finstock is <0.07 mm, and wherein the continuous strip casting process is twin roll casting with an average cooling rate not exceeding 1500° C./sec or belt and block casting with a maximum average cooling rate of less than 250° C./sec.

17. The aluminum alloy finstock of claim 16, wherein the continuous strip casting process is the twin roll casting with the average cooling rate greater than 200° C./sec.

18. An aluminum alloy finstock comprising the following composition in weight %:

| | |
|---|---|
| Fe | 0.8-1.25; |
| Si | 0.8-1.25; |
| Mn | 0.7-1.5; |
| Cu | 0.05-0.5; |
| Zn | up to 2.5; |

other elements less than or equal to 0.05 each and less than or equal to 0.15 in total; and balance aluminum, wherein the content of Fe and Si are approximately equal; and wherein the aluminum alloy finstock possesses a longitudinal UTS≥140 MPa and a conductivity≥46% IACS after brazing at 600° CU, and wherein a gauge of the aluminum alloy finstock is <0.07 mm.

* * * * *